US012097945B2

(12) United States Patent
Nakayasu

(10) Patent No.: US 12,097,945 B2
(45) Date of Patent: Sep. 24, 2024

(54) VESSEL OPERATION SYSTEM AND VESSEL

(71) Applicant: YAMAHA HATSUDOKI KABUSHIKI KAISHA, Iwata (JP)

(72) Inventor: Yoshikazu Nakayasu, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 456 days.

(21) Appl. No.: 17/696,405

(22) Filed: Mar. 16, 2022

(65) Prior Publication Data

US 2022/0297813 A1 Sep. 22, 2022

(30) Foreign Application Priority Data

Mar. 22, 2021 (JP) ..... 2021-047951

(51) Int. Cl.
*B63H 21/21* (2006.01)
*B63H 21/14* (2006.01)
*B63H 25/02* (2006.01)

(52) U.S. Cl.
CPC ..... *B63H 21/213* (2013.01); *B63H 21/14* (2013.01); *B63H 21/21* (2013.01); *B63H 25/02* (2013.01)

(58) Field of Classification Search
CPC ..... B63H 21/213; B63H 21/14; B63H 21/21; B63H 25/02
See application file for complete search history.

(56) References Cited

U.S. PATENT DOCUMENTS

2010/0191397 A1* 7/2010 Nose ..... B63H 25/42 701/21
2020/0331578 A1 10/2020 Sakashita et al.

FOREIGN PATENT DOCUMENTS

JP 2020-168921 A 10/2020

* cited by examiner

*Primary Examiner* — Stephen P Avila
(74) *Attorney, Agent, or Firm* — Keating & Bennett, LLP

(57) ABSTRACT

A vessel operation system includes a propulsion apparatus to generate a forward thrust or a backward thrust by output of an engine, a throttle actuator to change a throttle opening degree of the engine, a first operator, a second operator, and a controller. When the propulsion apparatus generates a backward thrust, the controller sets a first target value within a range not more than a first upper limit value in accordance with an operation of the first operator and control the throttle actuator so that the throttle opening degree reaches the first target value. The controller sets a second target value within a range not more than a second upper limit value larger than the first upper limit value in accordance with an operation of the second operator and control the throttle actuator so that the throttle opening degree reaches the second target value.

9 Claims, 7 Drawing Sheets

VESSEL OPERATION SYSTEM AND VESSEL

CROSS REFERENCE TO RELATED APPLICATIONS

This application claims the benefit of priority to Japanese Patent Application No. 2021-047951 filed on Mar. 22, 2021. The entire contents of this application are hereby incorporated herein by reference.

BACKGROUND OF THE INVENTION

1. Field of the Invention

The present invention relates to a vessel operation system and a vessel including such a system.

2. Description of the Related Art

Japanese Patent Application Publication No. 2020-168921 discloses a vessel including a hull and a propulsion system that is mounted on the hull and that is an example of a vessel operation system. This vessel additionally includes a steering wheel, a throttle lever, and a joystick that are disposed at a vessel operation seat of the hull. The propulsion system includes a pair of left and right outboard motors attached to a stern of the hull. Each of the outboard motors includes a propulsion unit turnable around a vertical turning shaft and an attachment mechanism that attaches the propulsion unit to the stern. The propulsion unit includes an engine and a propeller that generates a thrust by being rotated by the output of the engine. When the propulsion unit turns around the vertical turning shaft, a steering angle that is a direction of the thrust with respect to a center line of the hull is changed, and therefore the steering of the vessel is realized.

The steering wheel is operated by a vessel operator to steer. The throttle lever is operated by the vessel operator to adjust the throttle opening degree of the engine of each of the outboard motors. The joystick is operated by the vessel operator to steer and to adjust the throttle opening degree of the engine of each of the outboard motors. Therefore, in this vessel, a steering vessel operation by use of both the steering wheel and the throttle lever and a joystick vessel operation by use of the joystick are available.

In the steering vessel operation, when the vessel operator forwardly tilts the throttle lever, the shift position is changed to a forward position in the propulsion unit of each of the outboard motors, and the throttle opening degree is adjusted to reach a target value that has been set in accordance with a tilt amount of the throttle lever. As a result, a forward thrust is generated, and therefore it is possible to advance the vessel and to decelerate the vessel when it is traveling backwardly. When the vessel operator rearwardly tilts the throttle lever, the shift position is changed to a rearward position in the propulsion unit of each of the outboard motors, and the throttle opening degree is adjusted to reach a target value that has been set in accordance with a tilt amount of the throttle lever. As a result, a backward thrust is generated, and therefore it is possible to back the vessel and to decelerate the vessel when it is traveling forwardly.

In the joystick vessel operation, when the vessel operator forwardly tilts the joystick, the shift position is adjusted to a forward position in the propulsion unit of each of the outboard motors, and the throttle opening degree is adjusted to reach a target value that has been set in accordance with a tilt amount of the joystick. As a result, a forward thrust is generated. When the vessel operator rearwardly tilts the joystick, the shift position is adjusted to a rearward position in the propulsion unit of each of the outboard motors, and the throttle opening degree is adjusted to reach a target value that has been set in accordance with a tilt amount of the joystick. As a result, a backward thrust is generated. Additionally, for example, when the vessel operator rightwardly tilts the joystick, the propulsion unit of the left outboard motor leftwardly turns, and the shift position takes a forward position, and a right-forward thrust is generated. Additionally, at this time, the propulsion unit of the right outboard motor rightwardly turns, and the shift position takes a rearward position, and a right-backward thrust is generated. A resultant force of these thrusts, i.e., a composite thrust acts on the hull, and therefore the vessel rightwardly makes a lateral movement.

SUMMARY OF THE INVENTION

The inventor of preferred embodiments of the present invention described and claimed in the present application conducted an extensive study and research regarding a vessel operation system, such as the one described above, and in doing so, discovered and first recognized new unique challenges and previously unrecognized possibilities for improvements as described in greater detail below.

Usually, the vessel is designed with the aim of maximizing kinematic performance required when the vessel is advanced although Japanese Patent Application Publication No. 2020-168921 does not describe this. Therefore, it is usual to set the upper limit value of the target value of the throttle opening degree when the propulsion unit generates a forward thrust at a value close to 100% corresponding to the full opening of the throttle. On the other hand, usually, the vessel is designed on the assumption that the vessel moves at a low speed so as not to be covered with water from the rear side when the vessel travels backwardly. Therefore, it is usual to set the upper limit value of the target value of the throttle opening degree when the propulsion unit generates a backward thrust at a value much below 100%.

In a vessel capable of making a choice between the steering vessel operation and the joystick vessel operation, it is convenient and general to use the steering vessel operation when traveling at a high speed and to use the joystick vessel operation when traveling at a low speed for launching from and docking on shore, etc.

In the thus designed vessel, if the steering vessel operation and the joystick vessel operation are the same in characteristics of the target value of the throttle opening degree, there is a possibility that the vessel operator will feel that a sufficient thrust cannot be obtained in the vessel operation as described as follows.

Even if the vessel operator maximally rightwardly tilts the joystick in order to, for example, rightwardly move the vessel in the lateral direction, the throttle opening degree of the right outboard motor whose shift position takes a rearward position is small, and a right-backward thrust is small. In order to keep its balance, the throttle opening degree of the left outboard motor whose shift position takes a forward position is required to be nearly the same as the throttle opening degree of the right outboard motor, and therefore a right-forward thrust also becomes small. Therefore, rightward and leftward components of the composite thrust of the left and right outboard motors are small, and therefore there is a possibility that the vessel operator will feel that a sufficient thrust cannot be obtained in the left-right direction.

Therefore, the conventional vessel operation system has room for improvement to have a more excellent vessel operation feeling.

In order to overcome the previously unrecognized and unsolved challenges described above, a preferred embodiment of the present invention provides a vessel operation system to be installed in a vessel and including a propulsion apparatus to be mounted on a hull of the vessel, a throttle actuator, a first operator, a second operator, and a controller. The propulsion apparatus generates a forward thrust or a backward thrust by output of an engine. The throttle actuator changes a throttle opening degree of the engine. The first operator and the second operator are operable by a vessel operator. The second operator is separate from the first operator. When the propulsion apparatus generates a backward thrust, the controller sets a first target value within a range not more than a first upper limit value in accordance with an operation of the first operator, and controls the throttle actuator so that the throttle opening degree reaches the first target value. When the propulsion apparatus generates a backward thrust, the controller sets a second target value within a range not more than a second upper limit value larger than the first upper limit value in accordance with an operation of the second operator, and controls the throttle actuator so that the throttle opening degree reaches the second target value.

This arrangement makes it possible to, when the propulsion apparatus generates a backward thrust, set the target value of the throttle opening degree of the engine of the propulsion apparatus when the vessel operator operates the second operator within a range up to the second upper limit value larger than the first upper limit value set when the vessel operator operates the first operator. Therefore, the target value of the throttle opening degree is set at the second target value larger than the first upper limit value in accordance with the operation of the second operator, and, when an actual throttle opening degree reaches the second target value, the propulsion apparatus is able to generate a larger thrust in the backward direction. This makes it possible to improve a vessel operation feeling.

In a preferred embodiment of the present invention, the second operator may be a joystick.

In a preferred embodiment of the present invention, the second operator is a joystick, and the second upper limit value is a maximum value of the throttle opening degree.

With this arrangement, when the propulsion apparatus generates a backward thrust, it is possible to set the target value of the throttle opening degree of the engine when the vessel operator operates the joystick in a range up to the maximum value of the throttle opening degree. Therefore, the target value of the throttle opening degree is set at the maximum value in accordance with the operation of the joystick, and the propulsion apparatus is able to generate a maximum thrust in the backward direction when an actual throttle opening degree reaches the maximum value. This makes it possible to improve a vessel operation feeling.

In a preferred embodiment of the present invention, the vessel operation system further includes a first operation system including the first operator and a second operation system including the second operator. The first operation system generates a first request value indicating the throttle opening degree in accordance with an operation of the first operator. The second operation system generates a second request value indicating the throttle opening degree in accordance with an operation of the second operator. The controller sets a first target value based on the first request value and sets a second target value based on the second request value. When the propulsion apparatus generates a backward thrust, the controller sets the second target value, when the second request value is a maximum value, at a value larger than the first target value set when the first request value is a maximum value.

With this arrangement, the second target value set by the vessel operator operating the second operator so that the second request value reaches the maximum value is larger than the first target value set by the vessel operator operating the first operator so that the first request value reaches the maximum value. Therefore, when the target value of the throttle opening degree is set at the second target value in accordance with the operation of the second operator and when an actual throttle opening degree reaches the second target value, the propulsion apparatus is able to generate a larger thrust in the backward direction than when the target value of the throttle opening degree is set at the first target value. This makes it possible to improve a vessel operation feeling.

In a preferred embodiment of the present invention, when the propulsion apparatus generates a backward thrust, the controller sets the second target value, when the second request value is larger than zero and equal to or less than a maximum value, at a value larger than the first target value set when the first request value is equal to the second request value.

With this arrangement, the second target value set by the vessel operator operating the second operator so that the second request value reaches a certain value larger than zero and equal to or less than a maximum value is larger than the first target value when the first request value is equal to the certain value. Therefore, it is possible to generate a large thrust in the backward direction even when the second request value is not the maximum value. This makes it possible to improve a vessel operation feeling because a large thrust is easily obtained when the second operator is used.

In a preferred embodiment of the present invention, when the propulsion apparatus generates a backward thrust, the controller sets the second target value, when the second request value is in a total range larger than zero, at a value larger than the first target value set when the first request value is equal to the second request value.

With this arrangement, the second target value is larger than the first target value with respect to the same request value in the total range (excluding zero) of the second request value. Therefore, it is possible to generate a large thrust in the backward direction even if the second request value is any value larger than zero. This large thrust makes it possible to improve a vessel operation feeling.

In a preferred embodiment of the present invention, when the propulsion apparatus generates a forward thrust, the controller sets the second target value, when the second request value is larger than zero, at a value larger than the first target value set when the first request value is equal to the second request value.

With this arrangement, when the propulsion apparatus generates a forward thrust, the second target value set by the vessel operator operating the joystick so that the second request value reaches a certain value larger than zero is larger than the first target value set when the first request value is equal to this certain value. Therefore, the propulsion apparatus is able to generate a large thrust in the forward direction when the second operator is used. This makes it possible to improve a vessel operation feeling.

In a preferred embodiment of the present invention, the vessel operation system further includes a steering to change a steering angle of a thrust generated by the propulsion apparatus with respect to the hull. The controller controls the steering and changes the steering angle in accordance with an operation of the second operator.

This arrangement makes it possible to, when the second operator is operated by the vessel operator, set the target value of the throttle opening degree of the engine of the propulsion apparatus within a range up to the second upper limit value larger than the first upper limit value when the vessel operator operates the first operator. Therefore, it is possible to generate a large thrust using the second operator. Particularly in accordance with a change in the steering angle, it is possible to generate a large right-left-direction component when the thrust includes a right-left-direction component. This makes it possible to improve a vessel operation feeling.

Another preferred embodiment of the present invention provides a vessel including a hull and the vessel operation system installed on the hull.

This arrangement makes it possible to generate a large thrust in the backward direction from the propulsion apparatus using the second operator. This makes it possible to improve a vessel operation feeling.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
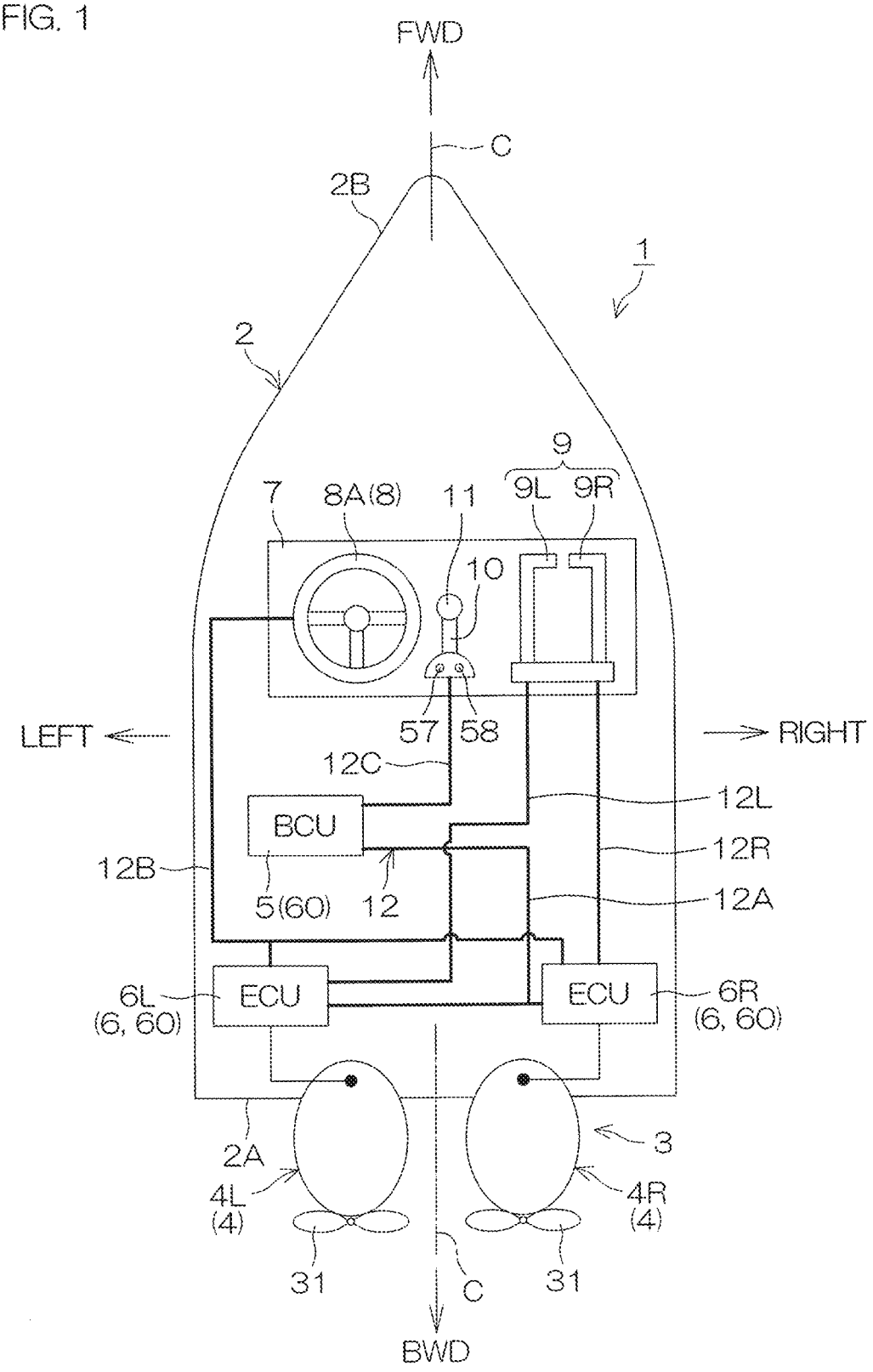
FIG. 1 is a conceptual diagram to describe an arrangement of a vessel according to a preferred embodiment of the present invention.

Preferred embodiments of the present invention will be hereinafter described in detail with reference to the accompanying drawings. FIG. 1 is a conceptual diagram to describe an arrangement in a plan view of a vessel 1 according to a preferred embodiment of the present invention. In FIG. 1, a forward direction (bow direction) of the vessel 1 is represented by an arrow FWD, and a backward direction (stern direction) thereof is represented by an arrow BWD. Additionally, a right-hand side (starboard side) direction of the vessel 1 is represented by an arrow RIGHT, and a left-hand side (port side) direction thereof is represented by an arrow LEFT.

A vessel 1 includes a hull 2 and a vessel operation system 3 mounted on the hull 2. The vessel operation system 3 includes a plurality of outboard motors 4, which are an example of a propulsion apparatus to be mountable on the hull 2, and a BCU (boat control unit) 5 that controls these outboard motors 4.

The plurality of outboard motors 4 are designed to be mounted and arranged side by side in a left-right direction at a stern 2A of the hull 2 and to generate a thrust at a more rearward position than a resistant center P (see FIG. 6 etc., described later) that is a momentary turning center of the hull 2. The resistant center P does not necessarily coincide with the gravity center of the hull 2 in a plan view, and is not necessarily placed at a fixed position in the hull 2.

In the present preferred embodiment, the plurality of outboard motors 4 include a left outboard motor 4L and a right outboard motor 4R that are attached to the stern 2A. The left and right outboard motors 4L and 4R are attached at laterally symmetrical positions with respect to a center line C that passes through the stern 2A and the bow 2B of the hull 2 and that follows the front-rear direction. More specifically, the left outboard motor 4L is attached to a rear portion of the left-hand side of the hull 2, and the right outboard motor 4R is attached to a rear portion of the right-hand side of the hull 2.

An ECU (electronic control unit) 6 is built into each of the left and right outboard motors 4L and 4R. The BCU 5 and the ECUs 6 may each include a microcomputer including a CPU (central processing unit) and a memory, and the microcomputer executes a predetermined software process. The ECU 6 built into the left outboard motor 4L is hereinafter referred to as the "left ECU 6L," and the ECU 6 built into the right outboard motor 4R is hereinafter referred to as the "right ECU 6R." However, for convenience, the left outboard motor 4L and the left ECU 6L are depicted in a state of being separate from each other, and the right outboard motor 4R and the right ECU 6R are depicted in a state of being separate from each other in FIG. 1.

An operational platform 7 for performing vessel operations is located at the vessel operation seat of the hull 2. The operational platform 7 is provided with a steering operation portion 8 operable to steer the vessel, a throttle operation portion 9 operable to adjust the output of each of the outboard motors 4, and a joystick 10 operable to steer the vessel and to adjust the output of each of the outboard motors 4. The steering operation portion 8 and the throttle operation portion 9 are each an example of a first operation element (first operator) operable by a vessel operator to perform a vessel operation. The joystick 10 is an example of a second operation element (second operator) that is separate from the first operation element and that is operable by the vessel operator to perform a vessel operation. These operation elements are included in the vessel operation system 3.

In the present preferred embodiment, an ordinary vessel operation (which is hereinafter referred to as "steering vessel operation") that uses the steering operation portion 8 and the throttle operation portion 9 and a vessel operation (which is hereinafter referred to as "joystick vessel operation") that uses the joystick 10 are available. In the operational platform 7, for example, the steering operation portion 8 is located at a position closer to the left, and the throttle operation portion 9 is located at a position closer to the right, and the joystick 10 is located between the steering operation portion 8 and the throttle operation portion 9, and yet these layouts may be arbitrarily changed.

The steering operation portion 8 includes a steering wheel 8A that is turnable rightwardly and leftwardly. The throttle operation portion 9 includes throttle levers 9L and 9R corresponding to the left and right outboard motors 4L and 4R, respectively. The left throttle lever 9L is used to perform the output control of the left outboard motor 4L. The right throttle lever 9R is used to perform the output control of the right outboard motor 4R. The throttle levers 9L and 9R are each turnable within a predetermined angular range in the front-rear direction. The tilt position of the throttle levers 9L and 9R when these are tilted by a predetermined amount forwardly from a neutral position is a forward shift-in position. The tilt position of the throttle levers 9L and 9R when these are tilted by a predetermined amount rearwardly from the neutral position is a backward shift-in position.

Each head portion of the throttle levers 9L and 9R is bent in a direction in which the head portions are adjacent to each other, and define a substantially horizontal gripping portion. This enables the vessel operator to simultaneously turn both of the throttle levers 9L and 9R and to control the output of the left and right outboard motors 4L and 4R while keeping the throttle opening degrees of the left and right outboard motors 4L and 4R so as to be equal or substantially equal to each other.

The joystick 10 is a lever that protrudes from the operational platform 7. The joystick 10 is tiltable freely in any direction, i.e., in forward, rearward, leftward, and rightward directions (including oblique directions) from a neutral position by being operated by the vessel operator. A knob 11 that is able to be rotationally operated around an axis of the joystick 10 is located at the head portion of the joystick 10. The knob 11 is an element of the joystick 10. The entirety of the joystick 10, instead of the knob 11, may be rotationally operated around its axis.

The BCU 5 communicates with each of the ECUs 6 through a communication bus 12 provided in the hull 2. The communication bus 12 includes, for example, a CAN (Control Area Network). The communication bus 12 includes a first communication bus 12A that connects the BCU 5 and each of the ECUs 6 together, a second communication bus 12B that connects the steering wheel 8A and each of the ECUs 6 together, and a third communication bus 12C that connects the BCU 5 and the joystick 10 together. The communication bus 12 includes a fourth communication bus 12L that connects the throttle lever 9L and the left ECU 6L together and a fifth communication bus 12R that connects the throttle lever 9R and the right ECU 6R together. An arrangement of the wiring of the communication bus 12 may be appropriately changed.

Figure 2:
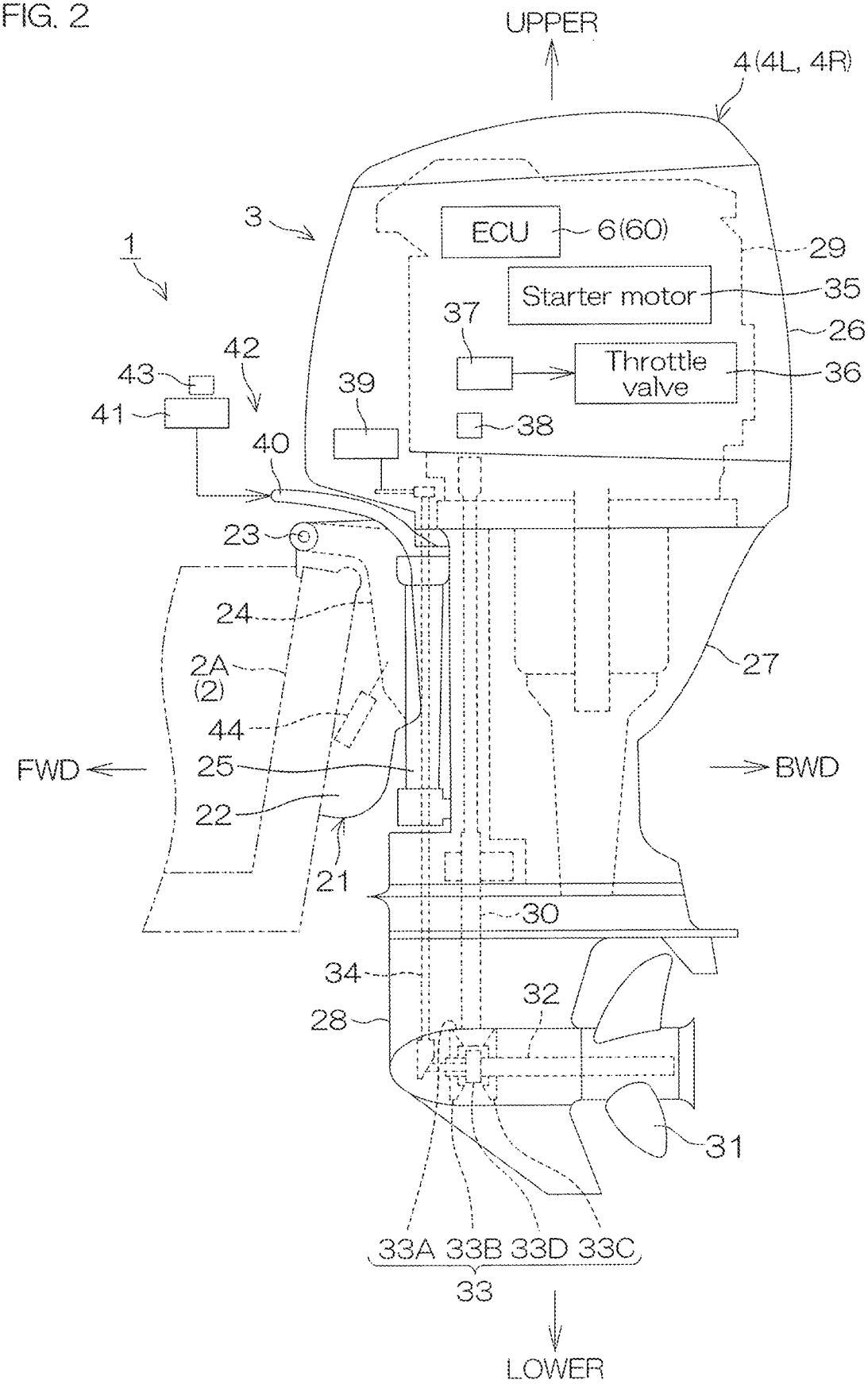
FIG. 2 is an illustrative cross-sectional view to describe an arrangement of a propulsion apparatus included in the vessel.

FIG. 2 is an illustrative cross-sectional view to describe an arrangement common to the left and right outboard motors 4L and 4R. Each of the outboard motors 4 is attached to the stern 2A of the hull 2 through an attachment mechanism 21. The attachment mechanism 21 may be regarded as an element of the outboard motor 4. The attachment mechanism 21 includes a clamp bracket 22 detachably fixed to the stern 2A and a swivel bracket 24 turnably joined to the clamp bracket 22 centering on a tilt shaft 23 defining a horizontal shaft. The trim angle of the outboard motor 4 is able to be changed by turning the swivel bracket 24 around the tilt shaft 23.

The outboard motor 4 is attached to the swivel bracket 24 turnably around a steering shaft 25 defining a vertical shaft. Thus, it is possible to change a steering angle (direction of a thrust generated by the outboard motor 4 with respect to the center line C of the hull 2) by turning the outboard motor 4 around the steering shaft 25.

A housing of the outboard motor 4 includes a top cowling 26, an upper case 27, and a lower case 28. An engine 29 functioning as a driving source is installed in the top cowling 26 so that an axis of its crankshaft follows an up-down direction. A drive shaft 30 that is used for power transmission and that is connected to a lower end of the crankshaft of the engine 29 extends in the up-down direction to the inside of the lower case 28 through the inside of the upper case 27.

A propeller 31 functioning as a thrust generating member is rotatably attached to the rear side of a lower portion of the lower case 28. A propeller shaft 32 that is a rotational shaft of the propeller 31 extends through the inside of the lower case 28 in a horizontal direction. The rotation of the drive shaft 30 is transmitted to the propeller shaft 32 through a shift mechanism 33 including a dog clutch.

The shift mechanism 33 includes a driving gear 33A fixed to a lower end of the drive shaft 30, a forward gear 33B and a backward gear 33C that are turnably provided on the propeller shaft 32, and a slider 33D located between the forward gear 33B and the backward gear 33C. The driving gear 33A, the forward gear 33B, and the backward gear 33C are bevel gears, respectively. The forward gear 33B engages with the driving gear 33A from the front side, whereas the backward gear 33C engages with the driving gear 33A from the rear side. Therefore, the forward gear 33B and the backward gear 33C are rotated in mutually opposite directions.

The slider 33D is spline-coupled to the propeller shaft 32. In other words, the slider 33D is slidable in its axial direction with respect to the propeller shaft 32, and yet cannot turn relatively to the propeller shaft 32, and rotates together with the propeller shaft 32. The slider 33D is slid on the propeller shaft 32 by turning the shaft of a shift rod 34 extending in the up-down direction in parallel with the drive shaft 30. Thus, the slider 33D is located at any one of the shift positions consisting of a forward position joined to the forward gear 33B, a backward position joined to the backward gear 33C, and a neutral position joined neither to the forward gear 33B nor to the backward gear 33C.

The rotation of the forward gear 33B to which a driving force of the engine 29 has been transmitted is transmitted to the propeller shaft 32 through the slider 33D when the slider 33D is in the forward position. Thus, the propeller 31 rotates unidirectionally, and generates a thrust in a direction (forward direction) in which the hull 2 is advanced. The rotation of the propeller 31 at this time is referred to as "positive rotation." On the other hand, the rotation of the backward gear 33C to which a driving force of the engine 29 has been transmitted is transmitted to the propeller shaft 32 through the slider 33D when the slider 33D is in the backward position. The backward gear 33C rotates in a direction opposite to that of the forward gear 33B, and therefore the propeller 31 rotates in an opposite direction, and a thrust in a direction (backward direction) in which the hull 2 is backed is generated. The rotation of the propeller 31 at this time is referred to as "reverse rotation." As thus described, the outboard motor 4 generates a forward thrust or a backward thrust by the engine 29. The rotation of the drive shaft 30 is not transmitted to the propeller shaft 32 when the slider 33D is in the neutral position. In other words, a driving-force-transmitting path between the engine 29 and the propeller 31 is shut off, and therefore a thrust in any direction is not generated.

A starter motor 35 by which the engine 29 is started is provided in the outboard motor 4. The starter motor 35 is controlled by the ECU 6. The outboard motor 4 is additionally provided with a throttle actuator 37 that changes the throttle opening degree by actuating a throttle valve 36 of the engine 29 and that changes an intake air flow of the engine 29. The throttle actuator 37 may include an electric motor. The operation of the throttle actuator 37 is controlled by the ECU 6. Therefore, the throttle valve 36 is an electronically-controlled throttle valve. The engine 29 is additionally provided with a throttle-opening-degree sensor 38 to detect the throttle opening degree.

In relation to the shift rod 34, a shift actuator 39 is provided to change the shift position of the slider 33D. The shift actuator 39 includes, for example, an electric motor, and is operated and controlled by the ECU 6.

A steering rod 40 that, for example, extends forwardly is fixed to the outboard motor 4. A steering actuator 41 controlled by the ECU 6 is joined to the steering rod 40. The steering actuator 41 may include, for example, a DC servo motor and a decelerator. The steering actuator 41 is driven, thus making it possible to turn the outboard motor 4 around the steering shaft 25 and to perform a steering operation. As thus described, a steering 42 that changes a steering angle includes the steering actuator 41, the steering rod 40, and the steering shaft 25 in the outboard motor 4. The steering 42 is included in the vessel operation system 3. The steering 42 is provided with a steering angle sensor 43 to detect a steering angle. The steering angle sensor 43 includes, for example, a potentiometer.

A trim actuator 44 that includes, for example, a hydraulic cylinder and that is controlled by the ECU 6 is provided between the clamp bracket 22 and the swivel bracket 24. The trim actuator 44 turns the outboard motor 4 around the tilt shaft 23, and changes a trim angle of the outboard motor 4 by turning the swivel bracket 24 around the tilt shaft 23.

Figure 3:
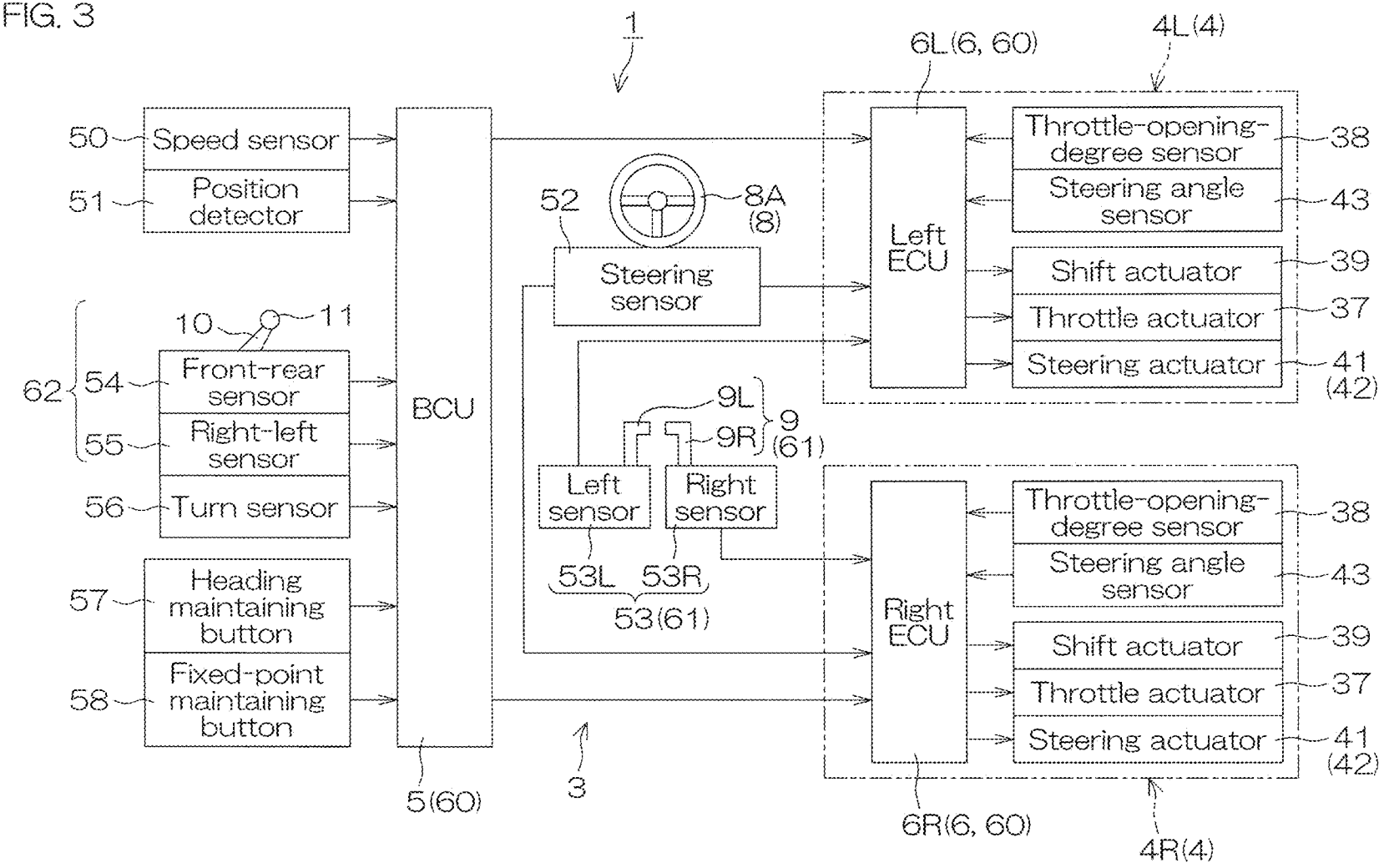
FIG. 3 is a block diagram showing an electrical arrangement of a vessel operation system included in the vessel.

FIG. 3 is a block diagram showing an electrical arrangement of the vessel operation system 3. The vessel operation system 3 additionally includes a speed sensor 50 to detect the traveling speeds of the vessel 1 traveling forwardly and backwardly and then inputs these detected speeds into the BCU 5 and a position detector 51 that generates a present-position signal of the vessel 1 and then inputs this signal into the BCU 5. The speed sensor 50 may include a pitot tube. The speed sensor 50 may be a log-speed sensor or may be a ground-speed sensor. The position detector 51 is a device that generates a present-position signal of the vessel 1, and may be, for example, a GPS receiver that receives radio waves from a GPS (Global Positioning System) satellite and then generates present-position information. The present-position signal may include information indicating the heading of the hull 2 (bow direction).

The vessel operation system 3 additionally includes a steering sensor 52 to detect a turning position (turning direction and turning amount) of the steering wheel 8A and then inputs the turning position into the left and right ECUs 6L and 6R. The vessel operation system 3 additionally includes left and right sensors 53L and 53R to detect tilt positions (tilt direction and tilt amount) in the front-rear direction of the throttle levers 9L and 9R, respectively, and then input the tilt positions into the left and right ECUs 6L and 6R, respectively. The left sensor 53L and the right sensor 53R are hereinafter referred to generically as the "throttle sensor 53" if necessary. The steering sensor 52 and the throttle sensor 53 may each include a potentiometer.

The vessel operation system 3 additionally includes a front-rear sensor 54 to detect a tilt position in the front-rear direction of the joystick 10 that has been tilted in an arbitrary direction and then inputs the tilt position into the BCU 5 and a right-left sensor 55 to detect a tilt position in the left-right direction of the joystick 10 and then inputs the tilt position into the BCU 5. When the joystick 10 is tilted in an oblique direction, which includes both the front-rear direction and the left-right direction, the oblique direction is decomposed into the front-rear direction and the left-right direction, and the tilt position in the front-rear direction is detected by the front-rear sensor 54, and the tilt position in the left-right direction is detected by the right-left sensor 55. The vessel operation system 3 additionally includes a turn sensor 56 to detect a turning position of the knob 11 and then inputs the turning position into the BCU 5. The front-rear sensor 54, the right-left sensor 55, and the turn sensor 56 may each include a potentiometer.

The vessel operation system 3 additionally includes a heading maintaining button 57 that is operationally pressed by the vessel operator in order to maintain the heading of the hull 2 while restraining the veering of the hull 2 and a fixed-point maintaining button 58 that is operationally pressed by the vessel operator in order to maintain the position of the hull 2 so as to be fixed at the present position. The heading maintaining button 57 and the fixed-point maintaining button 58 are each an example of the second operation element, and are each located at a position easily reached by a vessel operator's fingers in the operational platform 7, e.g., at a root of the joystick 10 (see FIG. 1). When the heading maintaining button 57 is operationally pressed, a signal to that effect is input into the BCU 5. This signal is an example of a second vessel operation command generated by the heading maintaining button 57. When the fixed-point maintaining button 58 is operationally pressed, a signal to that effect is input into the BCU 5. This signal is an example of a second vessel operation command generated by the fixed-point maintaining button 58.

In the steering vessel operation, a signal indicating the turning position of the steering wheel 8A is input into the left and right ECUs 6L and 6R as an example of a first vessel operation command generated by the steering operation portion 8. More specifically, each of the ECUs 6 sets a target value of the steering angle (which is hereinafter referred to as "target steering angle") in accordance with the turning position of the steering wheel 8A detected by the steering sensor 52. More specifically, each of the ECUs 6 sets a target steering angle for right-handed turning with respect to the turning operation of the steering wheel 8A in the rightward direction from the neutral position. Similarly, each of the ECUs 6 sets a target steering angle for left-handed turning with respect to the rotational operation of the steering wheel 8A in the leftward direction from the neutral position. In any case, the target steering angle is set so that its absolute value (deflection angle from the neutral position) becomes larger in proportion to an increase in the turning amount of the steering wheel 8A from the neutral position. Each of the ECUs 6 controls a corresponding one of the steering actuators 41 so that the steering angle detected by the steering angle sensor 43 coincides with the target steering angle. Ordinarily, the target steering angles of the left and right outboard motors 4L and 4R are set to be equal to each other.

In the steering vessel operation, a signal indicating the tilt position of the throttle lever 9L is input into the left ECU 6L, and a signal indicating the tilt position of the throttle lever 9R is input into the right ECU 6R. A signal indicating each of the tilt positions of the throttle levers 9L and 9R is an example of a first vessel operation command generated by the throttle operation portion 9.

More specifically, the left ECU 6L sets a shift position and a target value of the throttle opening degree for the left outboard motor 4L in accordance with a tilt position of the throttle lever 9L detected by the left sensor 53L. The target value of the shift position is hereinafter referred to as "target shift position," and the target value of the throttle opening degree is hereinafter referred to as "target throttle opening degree." The right ECU 6R sets a target shift position and a target throttle opening degree for the right outboard motor 4R in accordance with a tilt position of the throttle lever 9R detected by the right sensor 53R.

The tilt position of each of the throttle levers 9L and 9R includes a request value indicating the opening degree of the throttle valve 36, i.e., the throttle opening degree. Each of the ECUs 6 sets a target throttle opening degree based on a request value that has been input. If the forward tilt amount of the throttle lever 9L is more than a value corresponding to the forward shift-in position, the left ECU 6L sets the target shift position of the left outboard motor 4L as a forward position. When the throttle lever 9L is further tilted forwardly beyond the forward shift-in position, the left ECU 6L sets a larger target throttle opening degree in proportion to an increase in the tilt amount. Similarly, if the rearward tilt amount of the throttle lever 9L is more than a value corresponding to the backward shift-in position, the left ECU 6L sets the target shift position of the left outboard motor 4L as a backward position. When the throttle lever 9L is further tilted rearwardly beyond the backward shift-in position, the left ECU 6L sets a larger target throttle opening degree in proportion to an increase in the tilt amount.

When the tilt position of the throttle lever 9L is between the forward shift-in position and the backward shift-in position, the left ECU 6L sets the target shift position of the left outboard motor 4L as a neutral position. At this time, the driving force of the engine 29 is not transmitted to the propeller 31, and therefore a thrust from the outboard motor 4 is not generated. In other words, an operational range between the forward shift-in position and the backward shift-in position is a dead zone in which thrust is not generated, and the neutral position is included in the dead zone.

The right ECU 6R performs the same process with respect to the tilt position of the throttle lever 9R detected by the right sensor 53R. In other words, the right ECU 6R sets a target shift position and a target throttle opening degree of the right outboard motor 4R in accordance with the tilt position of the throttle lever 9R.

When the target shift position and the target throttle opening degree are set in this way, each of the ECUs 6 controls a corresponding one of the shift actuators 39 so that the slider 33D is located at the target shift position. Each of the ECUs 6 controls a corresponding one of the throttle actuators 37 so that the throttle opening degree detected by the throttle-opening-degree sensor 38 coincides with the target throttle opening degree.

In the joystick vessel operation, a signal, which indicates a tilt position of the joystick 10 and a turning position of the knob 11, is input into the BCU 5 as an example of a second vessel operation command generated by the joystick 10. The BCU 5 provides data, which shows a target shift position (forward, neutral, backward), a target throttle opening degree, and a target steering angle that are based on the second vessel operation command, to each of the ECUs 6.

More specifically, the BCU 5 sets a target shift position and a target throttle opening degree in accordance with a tilt position of the joystick 10. The tilt position of the joystick 10 includes a request value indicating an opening degree of the throttle valve 36. The BCU 5 sets a target value indicating a target throttle opening degree, i.e., an opening degree of the throttle valve 36 of each of the outboard motors 4 based on the request value that has been input.

More specifically, the BCU 5 sets the target shift position as the forward position if the forward tilt amount of the joystick 10 is larger than a value corresponding to the forward shift-in position. When the joystick 10 is further tilted forwardly beyond the forward shift-in position, the BCU 5 sets a larger target throttle opening degree in proportion to an increase in the tilt amount. Similarly, the BCU 5 sets the target shift position as the backward position if the rearward tilt amount of the joystick 10 is larger than a value corresponding to the backward shift-in position. When the joystick 10 is further tilted rearwardly beyond the backward shift-in position, the BCU 5 sets a larger target throttle opening degree in proportion to an increase in the tilt amount. The BCU 5 sets the target shift position as the neutral position when the tilt position in the front-rear direction of the joystick 10 is in the neutral position between the forward shift-in position and the backward shift-in position.

The BCU 5 sets a target steering angle in accordance with a turning position of the knob 11. More specifically, a target steering angle for left-handed turning is set with respect to the turning operation of the knob 11 in the leftward direction, and its absolute value (deflection angle from the neutral position) becomes larger in proportion to an increase in the turning amount from the neutral position. Similarly, a target steering angle for right-handed turning is set with respect to the turning operation of the knob 11 in the rightward direction, and its absolute value becomes larger in proportion to an increase in the turning amount from the neutral position.

In another operation example, the BCU 5 may set not only both a target shift position and a target throttle opening degree but also a target steering angle in accordance with the tilt in the diagonal leftward direction or in the diagonal rightward direction of the joystick 10. In that case, the BCU 5 sets a target steering angle for left-handed turning with respect to the tilt operation in the diagonal leftward direction of the joystick 10. Similarly, the BCU 5 sets a target steering angle for right-handed turning with respect to the tilt operation in the diagonal rightward direction of the joystick 10. In any case, the target steering angle is set so that its absolute value (deflection angle from the neutral position) becomes larger in proportion to an increase in the tilt amount of the joystick 10 from the neutral position.

The BCU 5 gives a target value (target shift position, target throttle opening degree, target steering angle), which has been set in this way, to the ECU 6 of each of the outboard motors 4. In the joystick vessel operation, ordinarily, target values of the left and right outboard motors 4L and 4R are set to be equal to each other. Each of the ECUs 6 controls a corresponding one of the shift actuators 39 so that the slider 33D is located at the target shift position. Each of the ECUs 6 controls a corresponding one of the throttle actuators 37 so that the throttle opening degree detected by the throttle-opening-degree sensor 38 coincides with the target throttle opening degree. Each of the ECUs 6 controls a corresponding one of the steering actuators 41 so that the steering angle detected by the steering angle sensor 43 coincides with the target steering angle.

The BCU 5 may set the target shift position, the target throttle opening degree, and the target steering angle in accordance with the operation in the left-right direction of the joystick 10 (operation in the exactly lateral direction). In that case, with respect to the tilt operation in the leftward direction of the joystick 10, the BCU 5 sets the target shift position, the target throttle opening degree, and the target steering angle for a leftward rectilinear movement without veering around the resistant center P. This rectilinear movement is referred to as "translational movement." With respect to the tilt operation in the rightward direction of the joystick 10, the BCU 5 sets the target shift position, the target throttle opening degree, and the target steering angle for a rightward translational movement. In the translational movement, the target shift position of the left outboard motor 4L and the target shift position of the right outboard motor 4R are set to be mutually opposite. The target throttle opening degree of the left outboard motor 4L and the target throttle opening degree of the right outboard motor 4R are set to be mutually the same. The BCU 5 sets a larger target throttle opening degree in proportion to an increase in the tilt amount of the joystick 10 from the neutral position. The absolute value of the target steering angle is set to be the same in the left outboard motor 4L and in the right outboard motor 4R, and yet the turning direction of the left outboard motor 4L and the turning direction of the right outboard motor 4R are set to be mutually opposite. This will be described in detail below.

Next, the request value indicating the throttle opening degree will be described in detail. An example of the unit of the request value is the same as the unit of the throttle opening degree, i.e., "%." Therefore, the fact that the request value is 100% denotes that the throttle opening degree is required to be 100% (the throttle is fully opened). The request value in the steering vessel operation is referred to as the "first request value," and the request value in the joystick vessel operation is referred to as the "second request value."

Hereinafter, a combination of the BCU 5 and the ECUs 6 is referred to as a controller 60, and each of the BCU 5 and the ECUs 6 is regarded as any one of a plurality of functional processing portions defining the controller 60. The controller 60 sets the first target value of the throttle opening degree based on the first request value, and sets the second target value of the throttle opening degree based on the second request value. An example of the unit of each of the first and second target values is the same as the unit of the throttle opening degree, i.e., "%."

The throttle operation portion 9 and the throttle sensor 53 that detect the tilt position of the throttle operation portion 9 define a first operation system 61 that generates a first request value corresponding to the tilt position of the throttle operation portion 9 in accordance with the operation of the throttle operation portion 9 (see FIG. 3). The joystick 10 and the front-rear and right-left sensors 54 and 55 that detect the tilt position of the joystick 10 define a second operation system 62 that generates a second request value corresponding to the tilt position of the joystick 10 in accordance with the operation of the joystick 10 (see FIG. 3). The first operation system 61 and the second operation system 62 are included in the vessel operation system 3.

Figure 4:
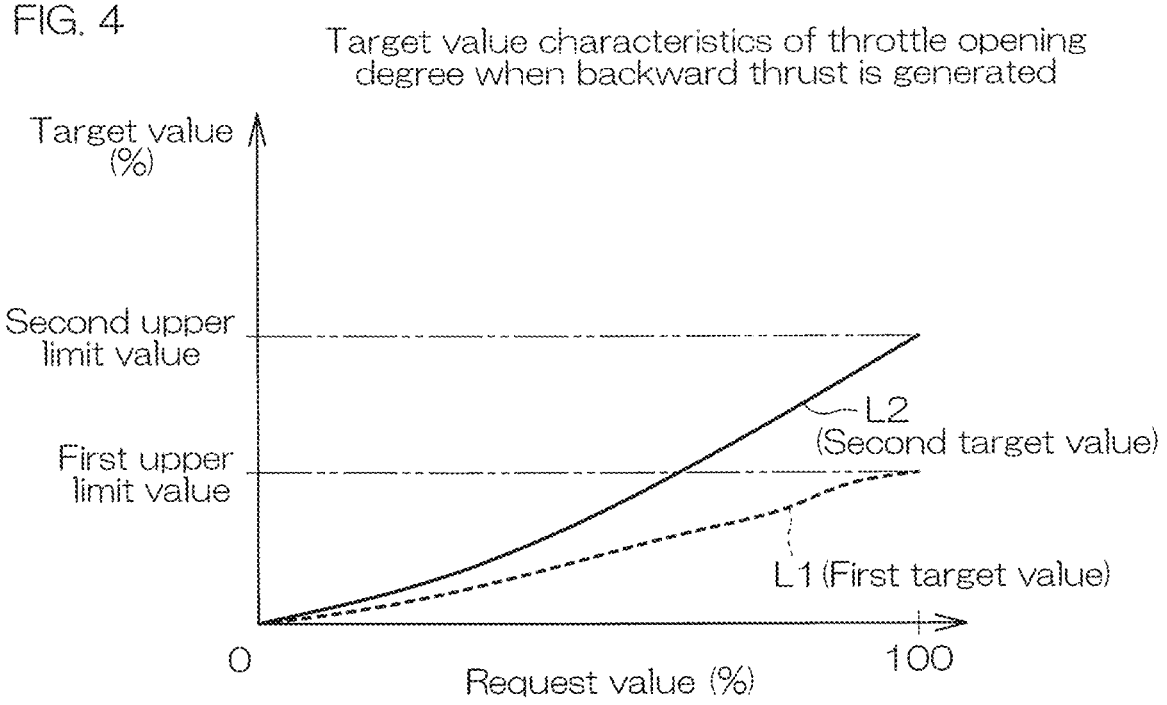
FIG. 4 is a graph showing characteristics of a target value of a throttle opening degree in an engine of the propulsion apparatus included in the vessel operation system when the propulsion apparatus generates a backward thrust.

A graph regarding the characteristics of the target value of the throttle opening degree shown in FIG. 4 is stored in a memory of, for example, the BCU 5 or the ECU 6 in the controller 60. This graph shows characteristics of the target value of the throttle opening degree when the outboard motor 4 generates a backward thrust. In the graph of FIG. 4, the abscissa axis represents a first request value and a second request value, and the ordinate axis represents a first target value and a second target value, and the broken line represents a characteristic line L1 of the first target value, and the solid line represents a characteristic line L2 of the second target value. In the present preferred embodiment, the steering vessel operation and the joystick vessel operation differ from each other in the relationship between the request value and the target value of the throttle opening degree, and therefore the characteristic line L1 and the characteristic line L2 do not coincide with each other.

The first target value when the first request value is a maximum value is referred to as the "first upper limit value," and the second target value when the second request value is a maximum value is referred to as the "second upper limit value." The second upper limit value is larger than the first upper limit value. In other words, the second target value when the second request value is a maximum value is larger than the first target value when the first request value is a maximum value. Although the maximum value of the first request value and the maximum value of the second request value are both 100%, and are equal to each other in the present preferred embodiment, these maximum values may be less than 100%, and may differ from each other.

When the outboard motor 4 generates a backward thrust, the controller 60 into which a first request value has been input by the steering vessel operation applies the first request value to the characteristic line L1, and sets a first target value corresponding to the first request value within a range not more than the first upper limit value. In other words, the controller 60 sets a first target value within a range not more than the first upper limit value in accordance with the operation of the steering operation portion 8 or the operation of the throttle operation portion 9 performed by the vessel operator. Furthermore, the controller 60 controls the throttle actuator 37 so that an actual throttle opening degree in the engine 29 reaches the first target value.

When the outboard motor 4 generates a backward thrust, the controller 60 into which a second request value has been input by the joystick vessel operation applies the second request value to the characteristic line L2, and sets a second target value corresponding to the second request value within a range not more than the second upper limit value. In other words, the controller 60 sets a second target value within a range not more than the second upper limit value in accordance with the operation of the joystick 10 operated by the vessel operator. In this case, the controller 60 sets the second target value when the second request value is a maximum value so as to be larger than the first target value when the first request value is a maximum value.

With respect to request values in the entire range excluding zero, the characteristic line L2 of the second target value exceeds the characteristic line L1 of the first target value in the present preferred embodiment. Therefore, the controller 60 sets the second target value, when the second request value is in the total range larger than zero, to be larger than the first target value when the first request value is equal to that second request value.

Only when the request value is within a predetermined range that includes neither zero nor the maximum value, the characteristic line L2 of the second target value may partially exceed the characteristic line L1 of the first target value. In that case, the controller 60 sets the second target value, when the second request value is within the predetermined range, to be a value larger than the first target value when the first request value is equal to that second request value.

Furthermore, the controller 60 controls the throttle actuator 37 so that an actual throttle opening degree in the engine 29 reaches the second target value.

Figure 5:
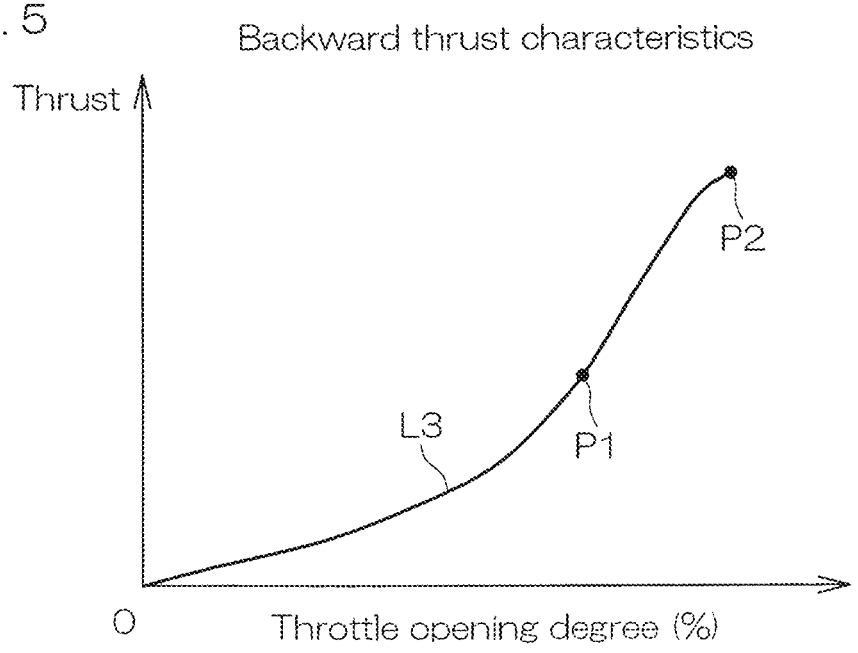
FIG. 5 is a graph showing characteristics of a backward thrust generated by the propulsion apparatus.

FIG. 5 is a graph showing characteristics of a backward thrust generated by the propulsion apparatus 4. In the graph of FIG. 5, the abscissa axis represents an actual throttle opening degree, and the ordinate axis represents a backward thrust, and the solid line represents a characteristic line L3 of the backward thrust. The backward thrust becomes larger along the characteristic line L3 in proportion to an increase in the throttle opening degree by the control of the throttle actuator 37.

In the steering vessel operation, the first target value of the throttle opening degree is fixed at a first upper limit value, and, in the joystick vessel operation, the second target value of the throttle opening degree is fixed at a second upper limit value larger than the first upper limit value (see FIG. 4). Therefore, in the steering vessel operation, an actual throttle opening degree does not exceed the first upper limit value, and therefore the backward thrust is limited to a first thrust P1 or less. On the other hand, the second target value of the throttle opening degree is fixed at the second upper limit value larger than the first upper limit value. Therefore, in the joystick vessel operation, it is possible to increase the actual throttle opening degree to the second upper limit value exceeding the first upper limit value, and therefore the backward thrust increases to a second thrust P2 larger than the first thrust P1. The second upper limit value may be the maximum value of the throttle opening degree, and the second thrust P2 in that case may be the maximum thrust in the backward direction generated by the engine 29.

Figure 6:
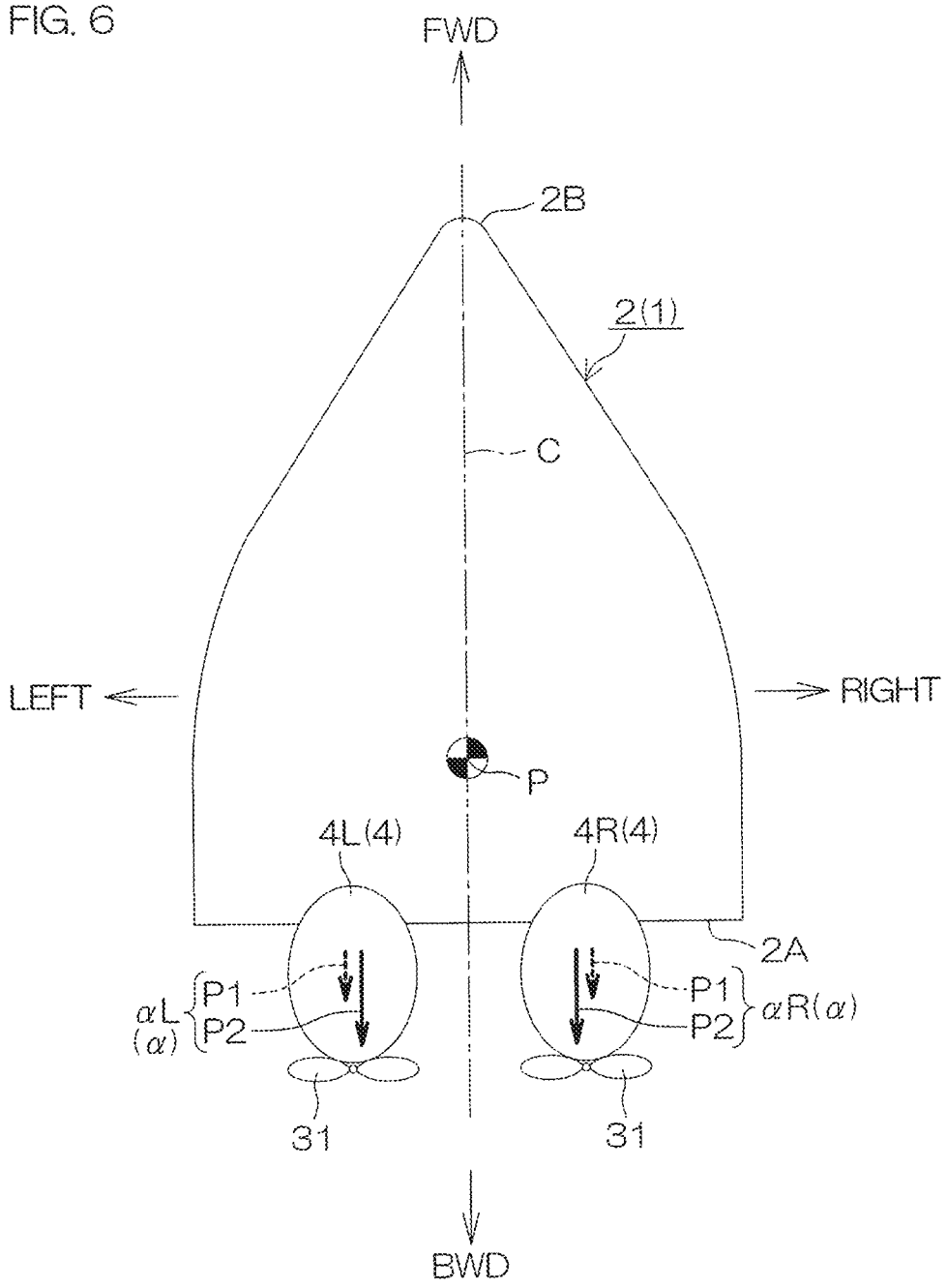
FIG. 6 is a plan view to describe a first behavior of the vessel during a vessel operation.
Figure 7:
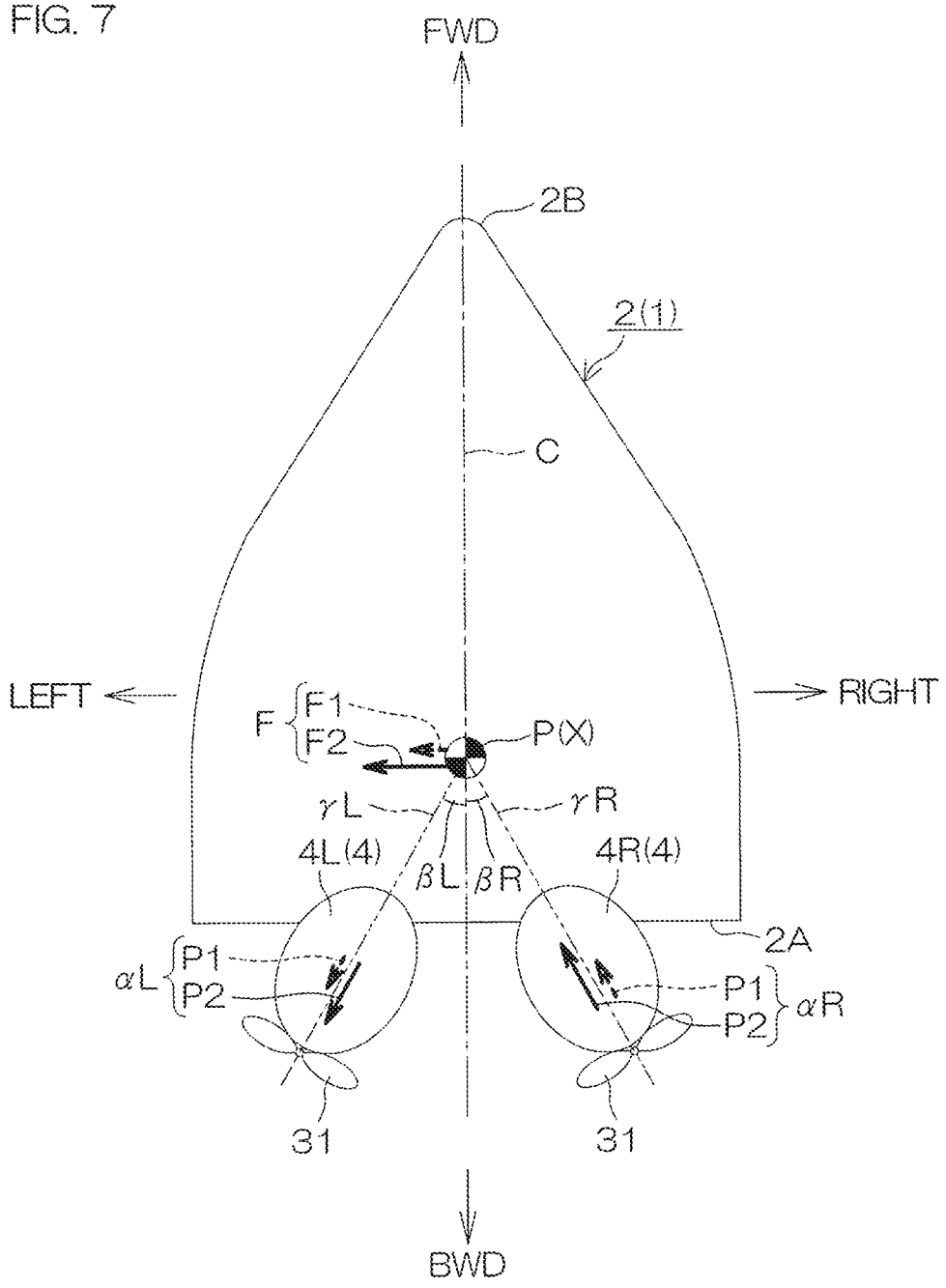
FIG. 7 is a plan view to describe a second behavior of the vessel during a vessel operation.

Next, various vessel operation patterns by the vessel operator will be described. FIG. 6 and FIG. 7 are schematic plan views to describe the behavior of the vessel 1 by a vessel operation of each pattern. The vessel operator simultaneously turns both of the throttle levers 9L and 9R rearwardly in a state in which the steering wheel 8A is kept in the neutral position in the steering vessel operation. Thereupon, the controller 60 sets the target steering angle at zero, and sets the target throttle opening degree (first target value described above) according to the tilt position of the throttle levers 9L and 9R, and therefore each of the outboard motors 4 generates a backward thrust α along the center line C of the hull 2 as shown in FIG. 6. Thus, the vessel 1 travels backwardly and straightly. The thrust α generated by the left outboard motor 4L is hereinafter referred to as "left thrust αL," and the thrust α generated by the right outboard motor 4R is hereinafter referred to as "right thrust αR." When the vessel 1 travels backwardly and straightly, the left thrust αL and the right thrust αR are equal to each other. The vessel 1 is designed with the aim of maximizing kinematic performance when the vessel travels forwardly, and therefore the vessel 1 is seldom allowed to travel backwardly and straightly.

When the vessel operator maximally turns the throttle levers 9L and 9R rearwardly, the controller 60 sets the first target value at the first upper limit value, and therefore the left thrust αL and the right thrust αR increase to the first thrust P1, and yet do not exceed the first thrust P1.

On the other hand, the vessel operator turns the joystick 10 rearwardly (in the exactly rearward direction) in the joystick vessel operation. Thereupon, the controller 60 sets the target steering angle at zero, and sets the target throttle opening degree (second target value described above) according to the tilt position of the joystick 10, and therefore each of the outboard motors 4 generates a backward thrust α along the center line C of the hull 2. When the vessel operator maximally turns the joystick 10 rearwardly, the controller 60 sets the second target value at the second upper limit value, and therefore the left thrust αL and the right thrust αR increase to the second thrust P2 larger than the first thrust P1. Thus, the vessel 1 travels backwardly, quickly, and straightly.

Referring to FIG. 7, the steering angle β of each of the outboard motors 4 is a deflection angle of a rotational axis of the propeller 31 of each of the outboard motors 4 with respect to the center line C of the hull 2. The rotational axis of the propeller 31 coincides with an acting line γ of a thrust α generated by the outboard motor 4 in a plan view. The steering angle β of the left outboard motor 4L is hereinafter referred to as the "left steering angle βL," and the steering angle β of the right outboard motor 4R is hereinafter referred to as the "right steering angle 13R." Additionally, the acting line γ of the left thrust αL is referred to as the "left acting line γL," and the acting line γ of the right thrust αR is referred to as the "right acting line γR."

In a preferred embodiment of the present invention, the steering angle β when the acting line γ is parallel to the center line C in a plan view is set at 0 degrees, and, as an example, the steering angle β when leftwardly increasing is defined as being a positive value, whereas the steering angle β when rightwardly increasing is defined as being a negative value.

Let it be supposed that, for example, the vessel operator leftwardly tilts the joystick 10 in the joystick vessel operation in a state in which both the left steering angle β: and the right steering angle βR are zero (see FIG. 6). In this case, the tilt position of the joystick 10, which has been leftwardly tilted, detected by the right-left sensor 55 is input into the controller 60. Thereupon, the controller 60 determines a hull target value that is a target value of a thrust F to be acted on the hull 2. Thereafter, the controller 60 determines an outboard-motor target value (target shift position, target throttle opening degree, target steering angle) of each of the outboard motors 4 according to the hull target value, and drives a corresponding one of the outboard motors 4 in accordance with the outboard-motor target value. Thus, the hull 2 leftwardly travels due to the thrust of each of the outboard motors 4.

More specifically, the controller 60 controls the steering 42 in accordance with the operation of the joystick 10, and changes the absolute value of the steering angle β of each of the outboard motors 4 so as to reach a value according to the tilt position of the joystick 10. Therefore, when the hull 2 is leftwardly moved, the controller 60 leftwardly turns the left outboard motor 4L, and rightwardly turns the right outboard motor 4R. The absolute value of the left steering angle βL and the absolute value of the right steering angle βR are equal to each other. Thereafter, the controller 60 causes the left outboard motor 4L to generate a left thrust αL in the backward direction, and causes the right outboard motor 4R to generate a right thrust αR in the forward direction. Therefore, a resultant force of the left and right thrusts αL and αR acts on the hull 2 as a leftward thrust F at an intersection position X of the left acting line γL and the right acting line γR on the center line C.

If the intersection position X coincides with the resistant center P of the hull 2, a moment does not occur at all, and therefore it is possible to move the vessel 1 leftwardly translationally.

Thereafter, the controller 60 sets the second target value at the second upper limit value when the steering angle 3 and the target throttle opening degree (second target value mentioned above) of each of the outboard motors 4 become larger in proportion to an increase in the tilt amount of the joystick 10 that has been leftwardly tilted. Thus, the left thrust αL and the right thrust αR increase to the second thrust P2 larger than the first thrust P1 as shown in FIG. 7. A thrust F that acts on the hull 2 when each thrust α is the first thrust P1 is referred to as "thrust F1," and a thrust F that acts on the hull 2 when each thrust α is the second thrust P2 is referred to as "thrust F2." The thrust F2 is larger than the thrust F1, and therefore the vessel 1 moves quickly, leftwardly, and translationally.

Figure 8:
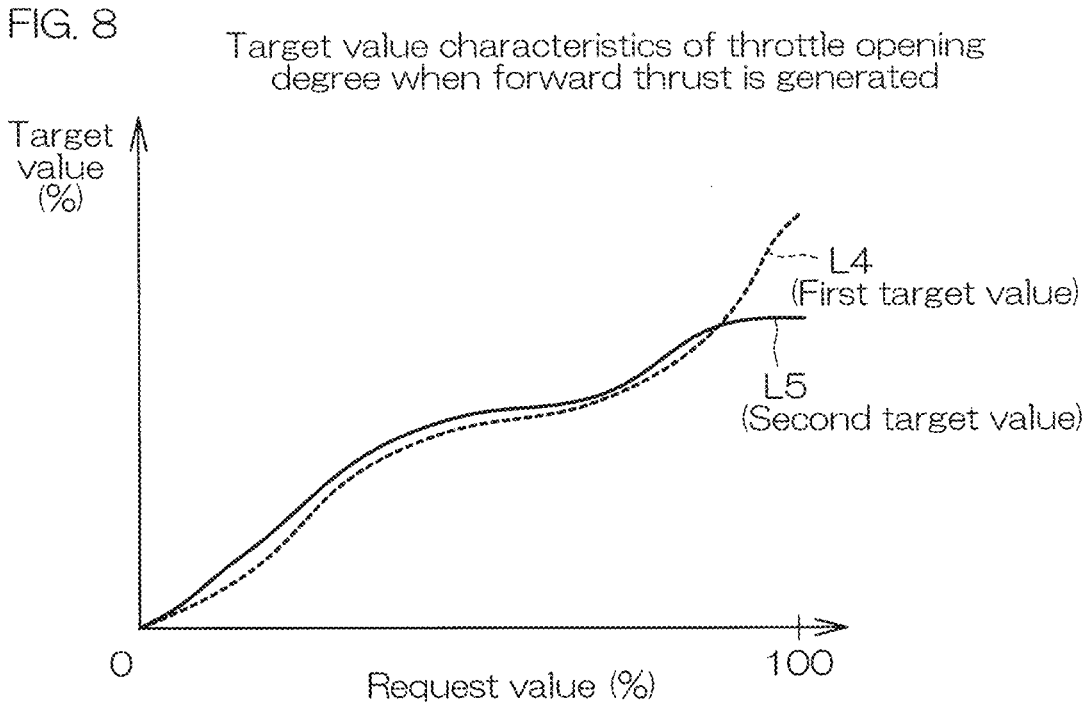
FIG. 8 is a graph showing characteristics of a target value of a throttle opening degree in the engine of the propulsion apparatus when the propulsion apparatus generates a forward thrust.

A graph regarding the characteristics of the target value of the throttle opening degree shown in FIG. 8 may be stored in the controller 60. This graph represents the characteristics of the target value of the throttle opening degree when the outboard motor 4 generates a forward thrust. In the graph of FIG. 8, the abscissa axis represents a first request value and a second request value, and the ordinate axis represents a first target value and a second target value, and the broken line represents a characteristic line L4 of the first target value, and the solid line represents a characteristic line L5 of the second target value.

When the outboard motor 4 generates a forward thrust, the controller 60 into which the first request value has been input by the steering vessel operation applies the first request value to the characteristic line L4, and sets a first target value corresponding to the first request value. Thereafter, the controller 60 controls the throttle actuator 37 so that an actual throttle opening degree in the engine 29 reaches the first target value.

When the outboard motor 4 generates a forward thrust, the controller 60 into which the second request value has been input by the joystick vessel operation applies the second request value to the characteristic line L5, and sets a second target value corresponding to the second request value.

If the thrust is a forward thrust, the characteristic line L4 of the first target value and the characteristic line L5 of the second target value may coincide with each other, and the characteristic line L5 may exceed the characteristic line L4 in the entire range excluding zero. In the present preferred embodiment, the characteristic line L5 partially exceeds the characteristic line L4. In the range in which the characteristic line L5 exceeds the characteristic line L4, the controller 60 sets the second target value at a value larger than the first target value set when the first request value is equal to that second request value. Thereafter, the controller 60 controls the throttle actuator 37 so that an actual throttle opening degree in the engine 29 reaches the second target value.

When the vessel operator operationally presses the heading maintaining button 57 or the fixed-point maintaining button 58, a maintenance command corresponding to the operation of this button is input into the controller 60. When the maintenance command is input thereinto, the controller 60 calculates the target value. More specifically, the controller 60 calculates an amount of momentary positional change of the vessel 1 based on a present-position signal of the vessel 1 generated by the position detector 51, and, from this amount, calculates an external force generated by waves or the like acting on the vessel 1. Thereafter, the controller 60 calculates target values of a thrust α and a steering angle β that are to be generated by each of the outboard motors 4 so that a resultant force matching with the external force calculated by the controller 60 is generated. If the outboard motor 4 is required to generate a backward thrust, the controller 60 may set the second target value within a range not more than the second upper limit value indicating the throttle opening degree of this outboard motor 4, and may calculate a target value of the thrust α based on the second target value. Thereafter, the controller 60 drives each of the outboard motors 4 so as to generate a thrust α of the target value, and controls the steering 42 so that the steering angle β reaches the target value. Thus, the heading and the position of the vessel 1 are maintained by the thrust α generated by each of the outboard motors 4.

The vessel 1 may include only one outboard motor 4. In this case, the single outboard motor 4 is attached to the central portion in the left-right direction of the stern 2A of the hull 2, and the throttle operation portion 9 of the vessel 1 includes only one throttle lever, and only one ECU 6 is provided.

As described above, when the outboard motor 4 generates a backward thrust α, the controller 60 sets a first target value within a range not more than a first upper limit value in accordance with the operation of the throttle operation portion 9, and controls the throttle actuator 37 so that a throttle opening degree reaches the first target value. On the other hand, the controller 60 sets a second target value in a range not more than a second upper limit value larger than a first upper limit value in accordance with the operation of the joystick 10, and controls the throttle actuator 37 so that a throttle opening degree reaches the second target value.

This arrangement makes it possible to, when the outboard motor 4 generates a backward thrust α, set the target value of the throttle opening degree of the engine 29 of the outboard motor 4 when the vessel operator operates the joystick 10 within a range up to a second upper limit value larger than a first upper limit value when the vessel operator operates the throttle operation portion 9. Therefore, the target value of the throttle opening degree is set at a second target value larger than a first upper limit value in accordance with the operation of the joystick 10, and, when an actual throttle opening degree reaches the second target value, the outboard motor 4 is able to generate a second thrust P2 that is larger in the backward direction. It is possible to obtain excellent vessel operation responsiveness by the second thrust P2 (see FIG. 6). Particularly in accordance with a change in the steering angle β, it is possible to generate a large right-left-direction component when the second thrust P2 includes a right-left-direction component. This makes it possible to move the vessel 1 quickly in the left-right direction (see FIG. 7). Therefore, it is possible to improve a vessel operation feeling.

In a preferred embodiment of the present invention, the first operation system 61 generates a first request value indicating a throttle opening degree in accordance with the operation of the throttle operation portion 9. The second operation system 62 generates a second request value indicating a throttle opening degree in accordance with the operation of the joystick 10. The controller 60 sets a first target value based on a first request value, and sets a second target value based on the second request value. When the outboard motor 4 generates a second thrust P2 in the backward direction, the controller 60 sets a second target value, when a second request value is a maximum value, at a value larger than the first target value when the first request value is a maximum value.

With this arrangement, the second target value set by the vessel operator operating the joystick 10 so that the second request value reaches the maximum value is larger than the first target value set by the vessel operator operating the throttle operation portion 9 so that the first request value reaches the maximum value. Therefore, when the target value of the throttle opening degree is set at the second target value in accordance with the operation of the joystick 10 and when an actual throttle opening degree reaches the second target value, the outboard motor 4 is able to generate a larger second thrust P2 in the backward direction than when the target value of the throttle opening degree is set at the first target value. This makes it possible to improve a vessel operation feeling.

Particularly in the present preferred embodiment, when the outboard motor 4 generates a backward thrust α, the controller 60 sets the second target value, when the second request value is in the total range larger than zero, at a value larger than the first target value when the first request value is equal to that second request value.

With this arrangement, the second target value is larger than the first target value with respect to the same request value in the total range (excluding zero) of the second request value (see FIG. 4). Therefore, it is possible to generate a large second thrust P2 in the backward direction even if the second request value is any value greater than zero. This large second thrust P2 makes it possible to improve a vessel operation feeling.

In a preferred embodiment of the present invention, when the outboard motor 4 generates a backward thrust α, the controller 60 may set a second target value, when a second request value is larger than zero and is equal to or less than a maximum value, at a value larger than a first target value when the first request value is equal to the second request value.

With this arrangement, the second target value set by the vessel operator operating the joystick 10 so that the second request value reaches a certain value larger than zero and equal to or less than a maximum value is larger than the first target value set when the first request value is equal to this certain value. Therefore, it is possible to generate a large second thrust P2 in the backward direction even when the second request value is not the maximum value. This makes it possible to improve a vessel operation feeling because a large thrust is easily obtained when the joystick 10 is used.

The second upper limit value may be the maximum value of the throttle opening degree. With this arrangement, when the outboard motor 4 generates a backward thrust α, it is possible to set the target value of the throttle opening degree of the engine 29 when the vessel operator operates the joystick 10 in a range up to the maximum value of the throttle opening degree. Therefore, the target value of the throttle opening degree is set at the maximum value in accordance with the operation of the joystick 10, and the outboard motor 4 is able to generate a maximum second thrust P2 in the backward direction when an actual throttle opening degree reaches the maximum value. This makes it possible to improve a vessel operation feeling.

In a preferred embodiment of the present invention, when the outboard motor 4 generates a forward thrust α, the controller 60 may set a second target value, when a second request value is larger than zero, at a value larger than a first target value when a first request value is equal to the second request value.

With this arrangement, when the outboard motor 4 generates a forward thrust α, the second target value set by the vessel operator operating the joystick 10 so that the second request value reaches a certain value larger than zero is larger than the first target value when the first request value is equal to this certain value. Therefore, the outboard motor 4 is able to generate a large second thrust P2 in the forward direction when the joystick 10 is used. This makes it possible to improve a vessel operation feeling.

Although preferred embodiments of the present invention have been described above, the present invention is not restricted to the contents of these preferred embodiments and various modifications are possible within the scope of the present invention.

For example, regarding the translational movement of the vessel 1, a leftward movement has been described, and yet this lateral movement is merely one example. Therefore, an arrangement regarding the target value of the throttle opening degree that is one of the features of preferred embodiments of the present invention is applicable to movements (including a translational movement) in all directions including a right-left-direction component, such as a diagonal movement, and is also applicable to movements (for example, turning during normal traveling) excluding a translational movement.

Additionally, an inboard/outboard motor or a waterjet drive may be used as an example of a propulsion apparatus other than the outboard motor 4. The inboard/outboard motor is a motor in which a prime mover is located inside the vessel and in which a drive unit including a thrust generating member and a steering mechanism is located outside the vessel. An inboard motor includes both a prime mover and a drive unit inside the hull 2 and in which a propeller shaft extends from the drive unit to the outside of the vessel. In this case, a steering mechanism is separately provided. The waterjet drive obtains a thrust by accelerating water sucked from a vessel bottom with a pump and by jetting the water from the jet nozzle of the stern. In this case, the steering mechanism includes a jet nozzle and a mechanism that turns the jet nozzle along a horizontal plane.

Also, features of two or more of the various preferred embodiments described above may be combined.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A vessel operation system to be installed in a vessel, the vessel operation system comprising:

a propulsion apparatus to be mounted on a hull of the vessel and to generate a forward thrust or a backward thrust by output of an engine;

a throttle actuator to change a throttle opening degree of the engine;

a first operator operable by a vessel operator to perform a vessel operation;

a second operator provided separately from the first operator and operable by the vessel operator to perform a vessel operation; and a controller configured or programmed to, when the propulsion apparatus generates a backward thrust:

set a first target value within a range not more than a first upper limit value in accordance with an operation of the first operator and control the throttle actuator so that the throttle opening degree reaches the first target value; and set a second target value within a range not more than a second upper limit value larger than the first upper limit value in accordance with an operation of the second operator and control the throttle actuator so that the throttle opening degree reaches the second target value.

2. The vessel operation system according to claim 1, wherein the second operator includes a joystick.

3. The vessel operation system according to claim 2, wherein the second upper limit value is a maximum value of the throttle opening degree.

4. The vessel operation system according to claim 1, further comprising:

a first operation system including the first operator to generate a first request value indicating the throttle opening degree in accordance with an operation of the first operator; and a second operation system including the second operator to generate a second request value indicating the throttle opening degree in accordance with an operation of the second operator; wherein the controller is configured or programmed to set the first target value based on the first request value and to set the second target value based on the second request value; and the controller is configured or programmed to, when the propulsion apparatus generates a backward thrust, set the second target value, when the second request value is a maximum value, at a value larger than the first target value set when the first request value is a maximum value.

5. The vessel operation system according to claim 4, wherein the controller is configured or programmed to, when the propulsion apparatus generates a backward thrust, set the second target value, when the second request value is larger than zero and equal to or less than a maximum value, at a value larger than the first target value set when the first request value is equal to the second request value.

6. The vessel operation system according to claim 5, wherein the controller is configured or programmed to, when the propulsion apparatus generates a backward thrust, set the second target value, when the second request value is in a total range larger than zero, at a value larger than the first target value set when the first request value is equal to the second request value.

7. The vessel operation system according to claim 4, wherein the controller is configured or programmed to, when the propulsion apparatus generates a forward thrust, set the second target value, when the second request value is larger than zero, at a value larger than the first target value set when the first request value is equal to the second request value.

8. The vessel operation system according to claim 1, further comprising:

a steering to change a steering angle of a thrust generated by the propulsion apparatus with respect to the hull; wherein the controller is configured or programmed to control the steering and change the steering angle in accordance with an operation of the second operator.

9. A vessel comprising:

a hull; and the vessel operation system according to claim 1 installed on the hull.

* * * * *